US008739710B1

(12) United States Patent
Taylor

(10) Patent No.: US 8,739,710 B1
(45) Date of Patent: Jun. 3, 2014

(54) EMBROIDERY HOOP

(71) Applicant: Claude Brent Taylor, Davidson, NC (US)

(72) Inventor: Claude Brent Taylor, Davidson, NC (US)

( * ) Notice: Subject to any disclaimer, the term of this patent is extended or adjusted under 35 U.S.C. 154(b) by 0 days.

(21) Appl. No.: 13/815,465

(22) Filed: Mar. 6, 2013

(51) Int. Cl.
*D05C 9/04* (2006.01)
*D06C 3/08* (2006.01)

(52) U.S. Cl.
USPC ..... 112/103; 38/102.2

(58) Field of Classification Search
USPC ..... 38/102–102.2, 102.4, 102.91; 112/103
See application file for complete search history.

(56) References Cited

U.S. PATENT DOCUMENTS 892,961 A * 7/1908 Kohler ..... 38/102.2
1,098,442 A * 6/1914 Huyck ..... 38/102.2
1,229,857 A * 6/1917 Alyea ..... 38/102.2
4,085,532 A * 4/1978 Hehn ..... 38/102.2
4,422,250 A * 12/1983 Golan ..... 38/102.2
4,642,924 A * 2/1987 Sudderth et al. ..... 38/102.2
4,726,130 A * 2/1988 Bussard ..... 38/102.2
2004/0040186 A1* 3/2004 Wilson ..... 38/102.2

* cited by examiner

*Primary Examiner* — Ismael Izaguirre
(74) *Attorney, Agent, or Firm* — Scott Richardson

(57) ABSTRACT

An embroidery hoop includes a first frame, a second frame and a resilient member. The first frame includes an inner surface and an outer surface. A second frame includes an inner surface, an outer surface and a split portion. The split portion of the second frame includes a pair of separate end portions. One of the first and second frames is positionable in circumscribing alignment with the other of the first and second frames. The resilient member spans the end portions of the second frame split portion and is operable to provide a biasing force for abutting the inner surface of one of the first and second frames against the outer surface of the other of the first and second frames when the first and second frames are in circumscribing alignment.

7 Claims, 5 Drawing Sheets

EMBROIDERY HOOP

BACKGROUND OF INVENTION

The present application relates generally to embroidery and more specifically to embroidery hoops or rings.

SUMMARY

Traditional embroidery hoops have two parts—an inner and outer ring. The purpose of the two rings is to secure an embroiderable item, or workpiece, during the embroidery process. With a workpiece disposed between the rings, the outer ring is typically tightened about the inner ring by means of a thumbscrew or bolt/screw so as to secure the workpiece in a taut position to the hoop. This method is difficult for persons with any form of carpal tunnel syndrome or arthritis in their hands. Also, the process of "hooping" a workpiece might require several adjustments to the tightness of the thumbscrew to create the correct amount of tension required to properly hold the workpiece during the embroidery process. Therefore, there exists a significant need for an improved embroidery hoop.

In one embodiment, an embroidery hoop comprises: a first frame, the first frame including an inner surface and an outer surface; a second frame, the second frame including an inner surface, an outer surface and a split portion, the split portion including a pair of separate end portions, wherein one of the first and second frames is positionable in circumscribing alignment with the other of the first and second frames; and a resilient member spanning the end portions of the second frame split portion, the resilient member operable to provide a biasing force for abutting the inner surface of one of the first and second frames against the outer surface of the other of the first and second frames when the first and second frames are in circumscribing alignment.

In another embodiment, an embroidery hoop comprises: an inner frame, the inner frame having an outer surface; an outer frame, the outer frame including an inner surface, an outer surface and a split portion, the split portion including first and second separated end portions, wherein the first and second end portions are moveable between a first position and a second position, wherein the distance between the first end portion and second end portion in the second position is greater than the distance between the first end portion and the second end portion in the first position, and wherein the outer frame is positionable in circumscribing alignment with the inner frame; and a resilient member spanning the first end portion and second end portion of the outer frame split portion, the resilient member operable to provide a biasing force for abutting the inner frame outer surface against the outer frame inner surface when the outer frame is positioned in circumscribing alignment with the inner frame.

In yet another embodiment, an embroidery hoop comprises: an outer frame, the outer frame having an inner surface; an inner frame, the inner frame including an outer surface and a split portion, the split portion including first and second separated end portions, wherein the first and second end portions are moveable between a first position and a second position, wherein the distance between the first end portion and second end portion in the second position is greater than the distance between the first end portion and the second end portion in the first position, and wherein the outer frame is positionable in circumscribing alignment with the inner frame; and a resilient member spanning the first end portion and second end portion of the inner frame split portion, the resilient member operable to provide a biasing force for abutting the inner frame outer surface against the outer frame inner surface when the outer frame is positioned in circumscribing alignment with the inner frame.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
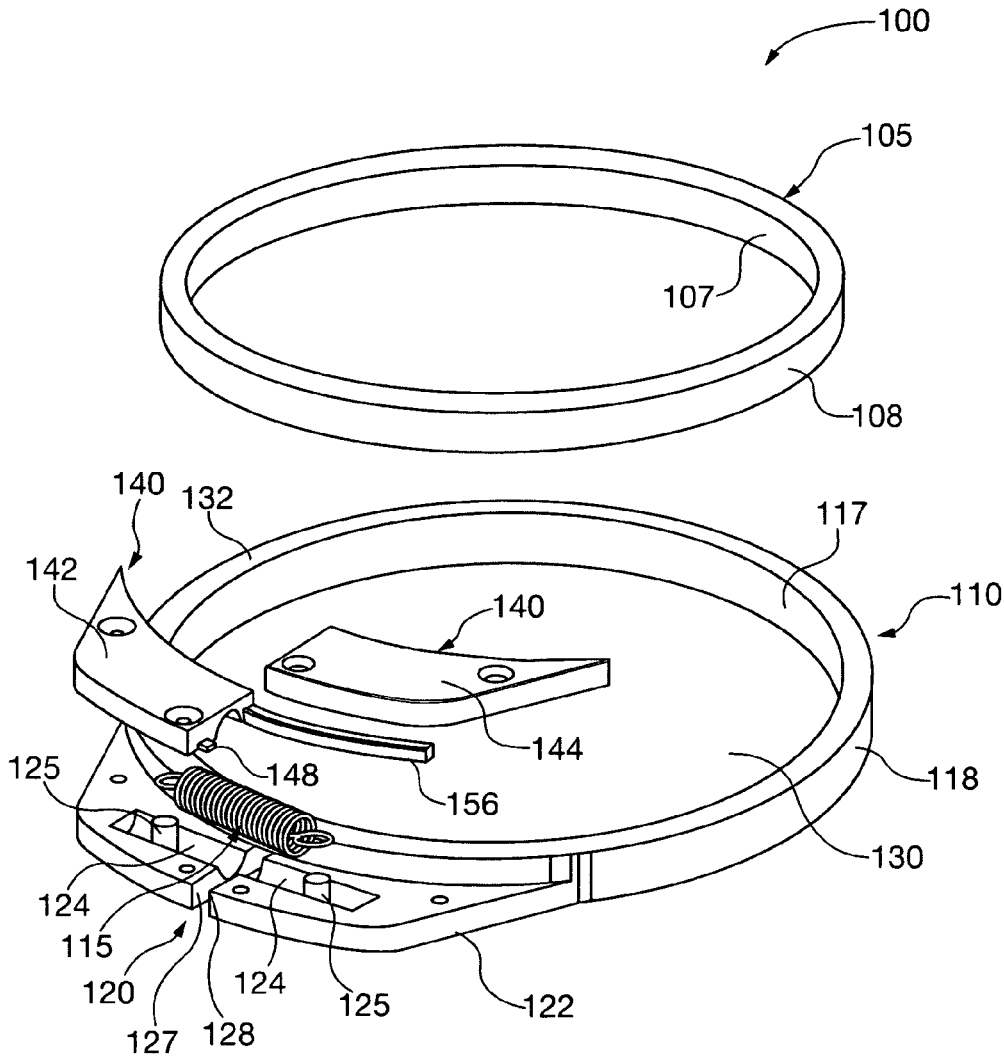
FIG. 1 is an exploded perspective view of an embroidery hoop.
Figure 2B:
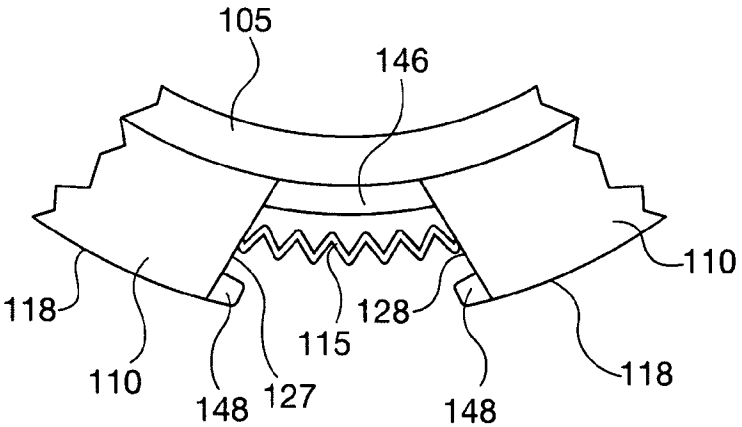
FIG. 2B is a partial top view of the embroidery hoop of FIG. 2A showing the first and second end portions of an outer frame split portion in a second position.
Figure 3:
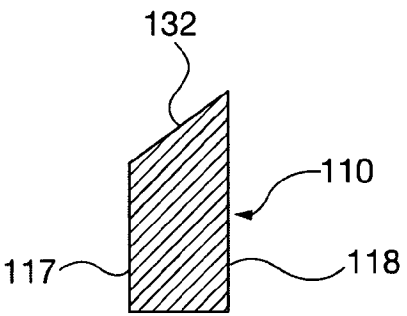
FIG. 3 is a cross-section taken along line 3-3 in FIG. 2A.
Figure 2A:
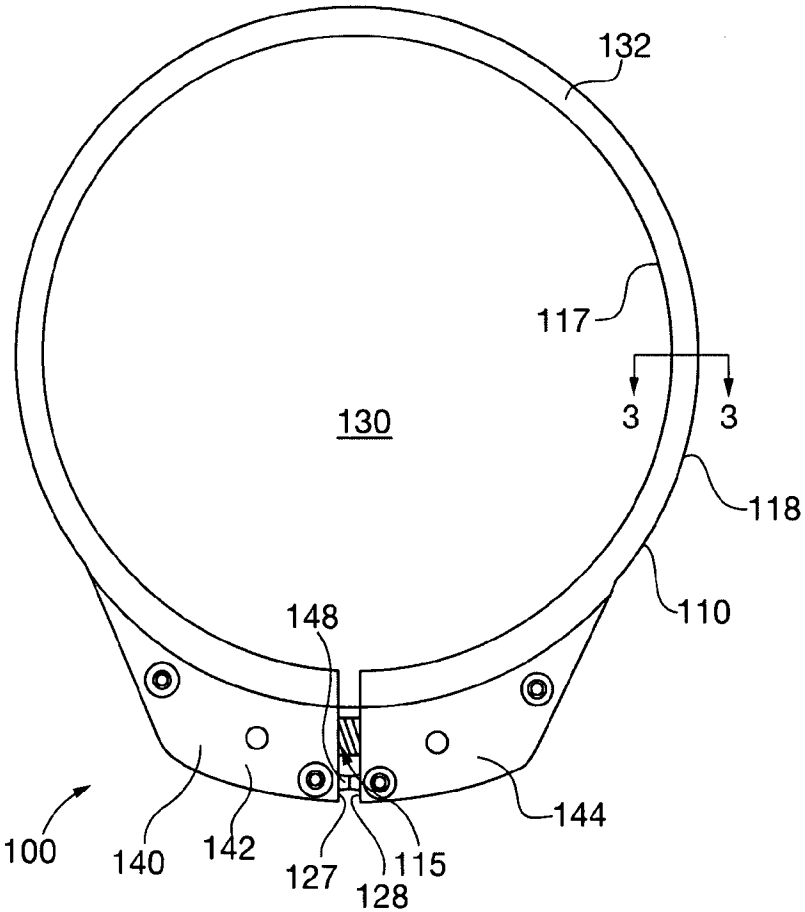
FIG. 2A is a top view of the embroidery hoop of FIG. 1 with the first and second end portions of an outer frame split portion in a first position.

Referring now to FIGS. 1-3, a first embodiment of an embroidery hoop 100 of the present disclosure is shown. The embroidery hoop 100 includes an inner frame 105, an outer frame 110, and a resilient member 115. As will be discussed further below, a workpiece, such as a piece of fabric or portion of clothing or any other item suitable for embroidery, is placed atop the outer frame 110. The inner frame 105 is then placed on the opposite side of the workpiece and pressed towards the outer frame 110 such that the inner frame 105 is received within the opening 130 defined by the outer frame 110. The resilient member 115 provides a biasing force that abuts the outer frame 110 against the inner frame 105 with a portion of the workpiece disposed therebetween.

The inner frame 105 includes an inner surface 107 and an outer surface 108. The inner frame 105 may have any suitable shape. In the illustrative embodiment, the inner frame 105 has a generally annular shape, however, it will be appreciated that the inner frame 105 may have any suitable shape including, but not limited to, rectangular, square, triangular, oval, pentagon, hexagon, octagon, or any other suitable shape. Additionally, as is generally known in the art, the inner ring 105 may include one or more machine attachment members extending therefrom so that the inner ring 105 may be coupled to an embroidery machine, and it will be appreciated that such machine attachment members may be employed by any of the following embodiments. However, it will be appreciated that the inner ring may be coupled to an embroidery machine using any suitable means, technique, or device(s) and remain within the scope of the present disclosure.

The outer frame 110 includes an inner surface 117, an outer surface 118 and a split portion 120. The outer frame 115 may also include an extension 122 for receiving and retaining the resilient member 115. In one embodiment, the extension 122 includes a recess portion and one or more prongs 125 therein for receiving and retaining the resilient member 115. However, it will be appreciated that the outer frame 110 may receive and retain the resilient member 115 in any number of ways and that the present disclosure is not solely limited to a recessed portion 124 and/or prongs 125. Also, as shown in the FIGS., the split portion 120 may extend through the extension 122.

The split portion 120 includes a first end portion 127 and a second end portion 128. The first and second end portions 127, 128 are moveable between a first position (FIG. 2A) and a second position (FIG. 2B). In the second position, the distance between the first end portion 127 and second end portion 128 is greater than the distance between the first and second end portions 127, 128 in the first position. As will be discussed further below, the first and second end portions 127, 128 are typically in the second position when the outer frame 110 has been positioned in circumscribing alignment with the inner frame 105 wherein the inner frame is within the opening 130 defined by the outer frame 110 and such that the resilient member 115 is providing a biasing force whereby the inner surface 117 of the outer frame 110 abuts the outer surface 108 of the inner frame 105. In contrast, the first position of the first and second end portions 127, 128 will typically be when the inner frame 105 is not engaged with the outer frame 110. It will be appreciated that the terms "first," "second" and "third" with respect to the positions of the first and second end portions 127, 128 are used to differentiate between different positions and that there is no specific numerical significance to the use of these terms and that other positions other than those described, either previously or subsequently, may exist and are considered within the scope of the present disclosure.

In one embodiment, the outer frame 110 includes a top surface 132. The top surface 132 may be tapered or angled towards the inner surface 117 so as to assist in guiding the inner frame 105 into the opening 130 defined by the outer frame 110. In the illustrative embodiment, the outer frame 110 has a generally annular shape, however, it will be appreciated that the outer frame 110 may have any suitable shape including, but not limited to, rectangular, square, triangular, oval, pentagon, hexagon, octagon, or any other suitable shape. In the illustrative embodiment, the inner frame 105 and outer frame have similar shapes (e.g. both being generally annular), however, it will be appreciated that embodiments where the frames 105, 110 have complimentary shapes such that a workpiece is still capable of being retained taut therebetween may be employed and remain within the scope of the present disclosure (e.g. an octagon shaped inner frame that is received by an annular outer frame, etc.).

The resilient member 115 spans the split portion 120 of the outer frame 110. The resilient member 115 may be any suitable device, combination of devices, means or mechanism operable to provide a biasing force capable of abutting the inner frame outer surface 108 against the outer frame inner surface 117 when the outer frame 110 is positioned in circumscribing alignment with the inner frame 105. In one embodiment, the resilient member 115 may also bias the first and second end portions 127, 128 of the outer frame split portion 120 in the first position when the inner frame 105 is not in alignment with the outer frame 110. In the illustrative embodiment, the resilient member 115 is an extension spring. In an alternative embodiment, the resilient member 115 may be one or more elastic members. However, it will be appreciated that any device, means or mechanism for accomplishing the forgoing may be employed and remain within the scope of the present disclosure.

The embroidery hoop 100 may optionally include a cover 140 for shielding the resilient member 115 and/or securing the resilient member 115 in proper position. The cover 140 may include a first portion 142 disposed adjacent to the first end 127 of the outer frame split portion 120 and a second portion 144 disposed adjacent to the second end 128 of the outer frame split portion 120. The first portion 142 may include a guiding extension 146 that slidingly engages the second portion 144, but it will be appreciated that a cover 140 without such extension 146 will also be considered within the scope of the present disclosure. Further, one or both of the cover portions 142, 144 may each include a protrusion 148 that may engage one another when the first and second end portions 127, 128 are in the first position, or, alternatively may otherwise engage an opposed end portion 127, 128 of the outer frame split portion 120 such that tension is maintained in the resilient member 115.

In use, a workpiece is disposed atop the outer frame 110. The inner frame 105 is then aligned with the outer frame 110 and pressed into the opening 130 defined by the outer frame 110. In doing so, the outer frame 110 is flexed such that the first and second end portions 127, 128 of the outer frame split portion 120 are moved to the second position. When the inner frame 105 is so disposed within the opening 130, the resilient member 115 provides a biasing force such that the inner frame outer surface 108 abuts the outer frame inner surface 117 with a portion of the workpiece therebetween. The workpiece is then held taut by the hoop 100 so that embroidery may be applied thereto. For the purposes of this disclosure, it will be understood that surfaces engaging or abutting one another due at least in part to a biasing force provided by a resilient member shall be considered engaging or abutting one another whether or not a portion of a workpiece is disposed between the surfaces. In other words, for the purposes of this disclosure and the claims, the terms "engaging" or "abutting" do not necessarily require physical contact between two surfaces but are to be understood broadly so as to at least also encompass arrangements with a portion of a workpiece disposed between the surfaces.

Figure 4:
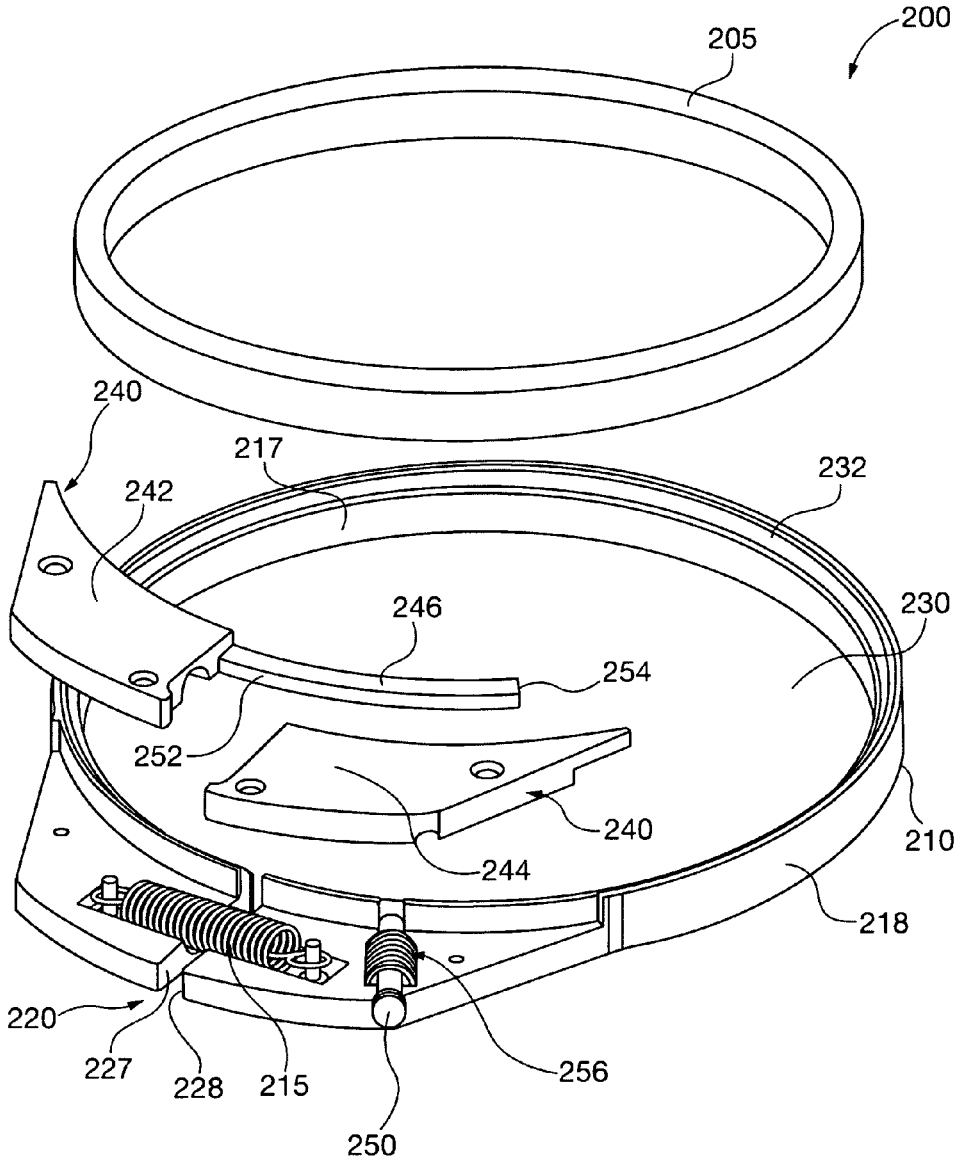
FIG. 4 is an exploded perspective view of an embroidery hoop.
Figure 5B:
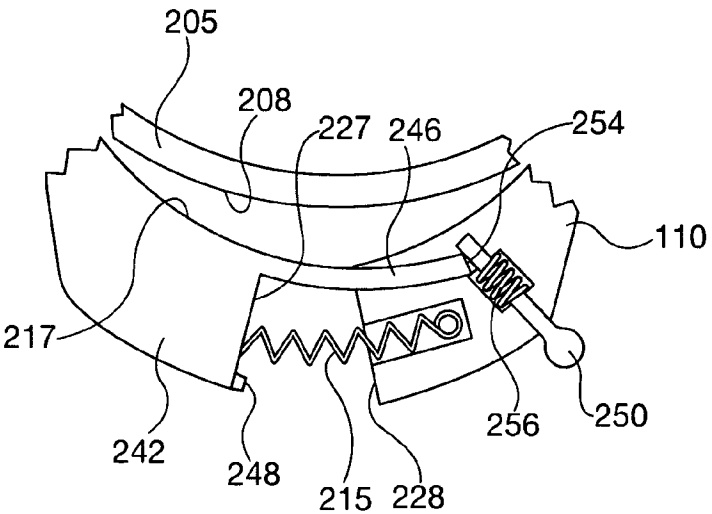
FIG. 5B is a partial top view of the embroidery hoop of FIG. 5A showing the first and second end portions of an outer frame split portion in a third position.
Figure 5A:
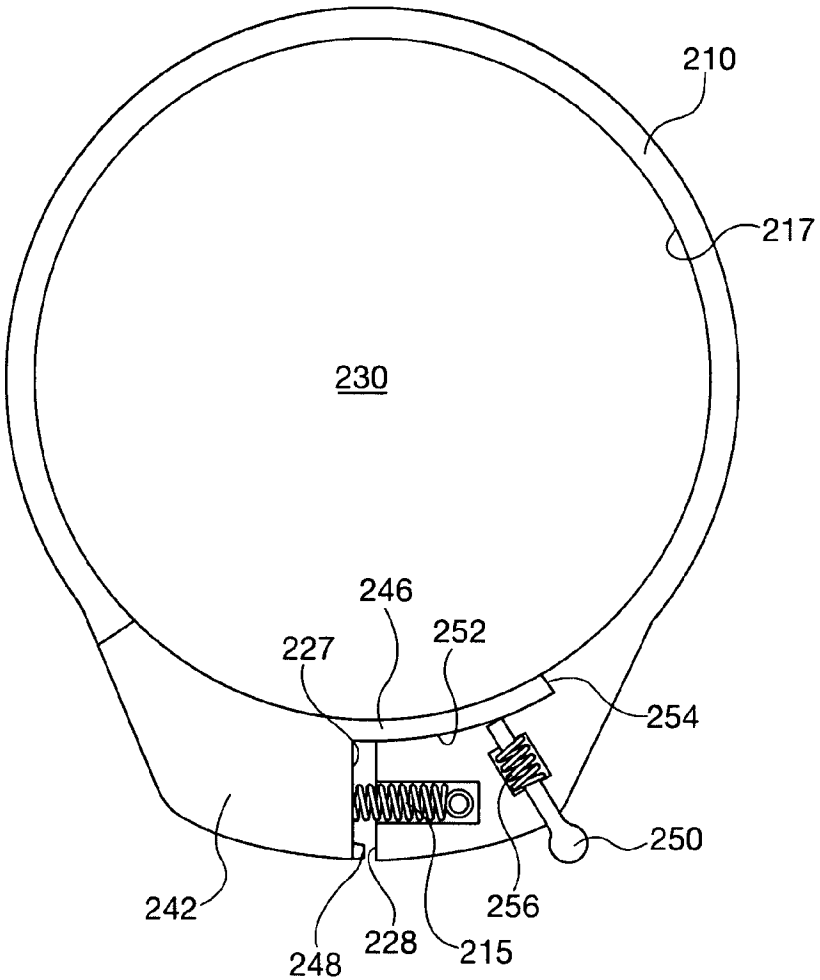
FIG. 5A is a top view of the embroidery hoop of FIG. 4 with the first and second end portions of an outer frame split portion in a first position, and with the second cover portion removed from the hoop.

Referring now to FIGS. 4-5B, another illustrative embodiment of an embroidery hoop 200 is shown. The embroidery hoop 200 is analogous in most respects to the embroidery hoop 100 of FIGS. 1-3 and a correlation of parts is generally indicated in this embodiment by indexing the numerals in FIGS. 1-3 by 100.

The first and second end portions 227, 228 of the outer frame split portion 220 are moveable to a third position where the distance between the end portions 227, 228 is greater than the distance between the end portions 227, 228 in the second position. As will be discussed further, in this third position, the outer frame 210 is flexed to receive the inner frame 205 within the opening defined by the 230 outer frame 210, but the respective surfaces 208, 217 are not in full engagement or fully abutting one another.

The embroidery hoop 200 also includes a pin 250 extending through the surfaces 217, 218 of the outer frame 210. The pin 250 is moveable between a disengaged position (FIG. 5A), where the end of the pin 250 abuts a side 252 of the first cover member extension 246, and an engaging position (FIG. 5B) where the pin 250 engages the terminal end 254 of the first cover member extension 246.

When the pin 250 is in the disengaged position, the end portions 227, 228 of the outer frame split portion 220 are in one of the first and second positions. When the pin 250 is in the engaging position, the pin 250 maintains the outer frame 210 in the flexed position where the first and second end portions 227, 228 of the outer frame split portion 220 are in the third position. The hoop 200 may include a second resilient member 256 operable to bias the pin 250 towards first cover portion extension 246 such that the pin 250 abuts side portion 252 of the extension 246 and is forced, by the second resilient member 256, to the engaging position when the outer frame 210 is flexed such that the ends 227, 228 are in the aforementioned third position. In the illustrative embodiment, the second resilient member 256 is a compression spring, but it will be appreciated that the second resilient member may be any suitable device, devices, means, or mechanism capable of biasing the pin 250 towards the extension 246.

In operation, the outer frame 210 is flexed such that the split portion end portions 227, 228 are in the third position wherein the pin 250 is moved, by way of the second resilient member 256, to the engaging position where the pin 250 engages the terminal end 254 of the first cover portion extension 246. A workpiece may be placed atop the outer frame 210. The inner frame 205 may then be aligned with the outer frame 210 and pressed into the opening 230 defined by the outer frame 210. A user may then pull the pin 250 to the disengaged position. The end portions 227, 228 of the outer frame split portion 220 are then moved, by way of a biasing force provided by the resilient member 215, to the second position such that a portion of the workpiece is held between the abutting surfaces 208, 217 of the frames 205, 210. The workpiece is then held taut by the hoop 200 so that embroidery may be applied thereto.

Figure 6:
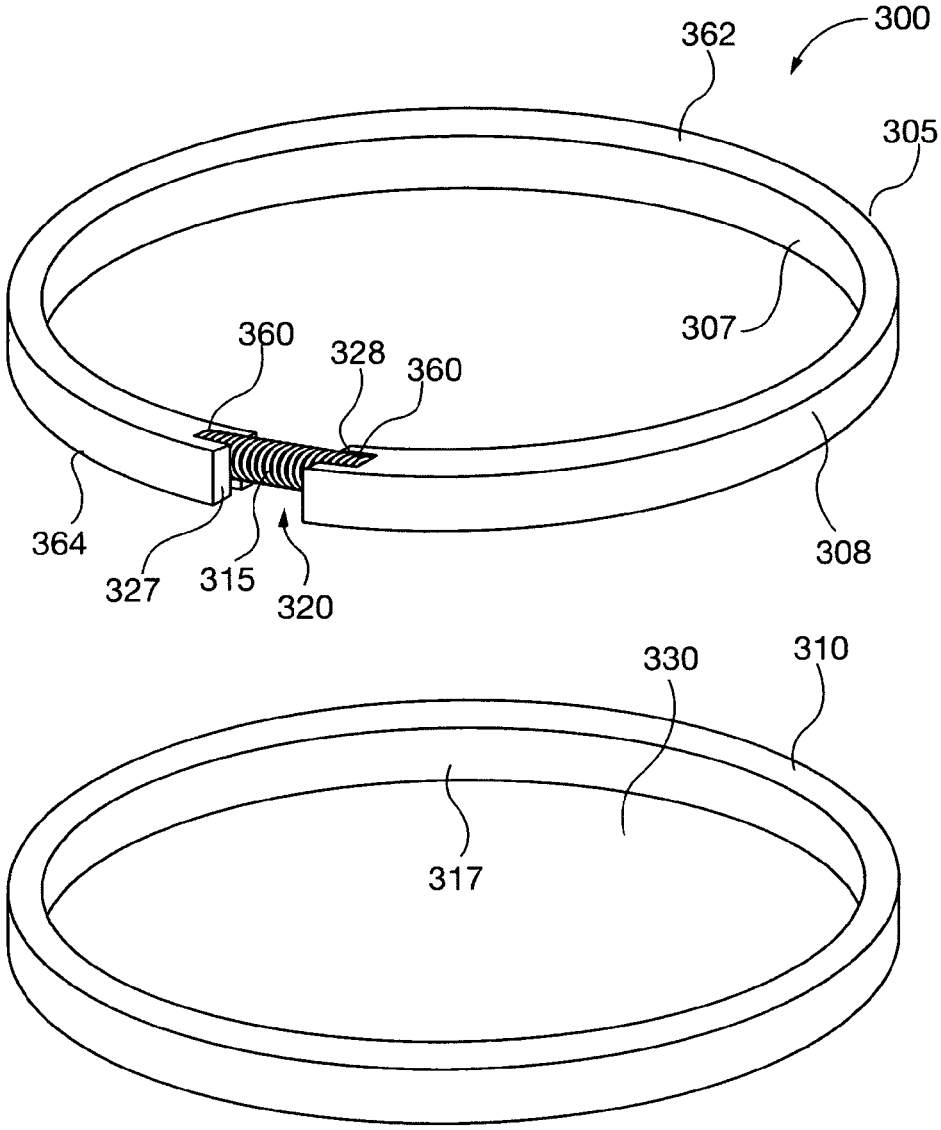
FIG. 6 an exploded perspective view of an embroidery hoop.

Referring now to FIG. 6, an alternative embodiment of an embroidery hoop 300 is shown. In this embodiment, the inner frame 305 includes the split portion 320 rather than the outer frame 310 as in the prior examples. The resilient member 315 spans the split portion 320 of the inner frame 305. The first end portion 327 and second end portion 328 of the inner frame split portion 320 are moveable between a first position and a second position. The distance between the end portions 327, 328 is greater in the first position. When the inner frame 305 is pressed into the opening 330 defined by the outer frame 310, the inner frame 305 is flexed such that the end portions 327, 328 are moved to the second position. When the inner frame 305 is so disposed within the opening 330, the resilient member 315 provides a biasing force such that the inner frame outer surface 308 abuts the outer frame inner surface 317 with a portion of the workpiece therebetween. As such, the workpiece is held taut by the hoop 100 so that embroidery may be applied thereto.

In the illustrative embodiment, the resilient member 315 is a compression spring, but it will be appreciated that the resilient member may be any suitable device, combination of devices, means or mechanism for providing a biasing force when the inner frame 305 is disposed within the outer frame 310. Also, in the illustrative embodiment, each end 327, 328 of the inner frame split end 320 includes an opening 360 for receiving a corresponding end of the resilient member 315. The openings 360 may be slots as shown or, alternatively, may be bores in the surfaces of one or both end portions 327, 328 of the split end 320 and sized to receive at least a portion of the resilient member 315. The inner frame 305, resilient member 315, and openings 360 may be sized such that the resilient member 315 does not extend past any external surface (top 362, bottom 364, inner 307 or outer 308) of the inner frame 305 so that the resilient member 315 does not impede operation of the hoop 300 and/or the embroidery operation. Also, in this embodiment, the outer ring 310 may include one or more machine attachment members extending therefrom so that the outer ring 310 may be coupled to an embroidery machine. However, it will be appreciated that the outer ring 310 may be coupled to an embroidery machine using any suitable means, technique, or device(s) and remain within the scope of the present disclosure.

The elements of each of the forgoing embodiment may have any suitable dimension and may be formed from any suitable material including, but not limited to, polymer, metal, composite, or any combination thereof. Also, while the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements. It will further be appreciated that any singular portion or any suitable combination of the forgoing is expressly contemplated and that the present disclosure is not limited to a single embodiment including all of the forgoing.

What is claimed is:

1. An embroidery hoop comprising:

an inner frame, the inner frame having an outer surface;

an outer frame, the outer frame including an inner surface, an outer surface and a split portion, the split portion including first and second separated end portions, wherein the first and second end portions are moveable between a first position and a second position, wherein the distance between the first end portion and second end portion in the second position is greater than the distance between the first end portion and the second end portion in the first position, and wherein the outer frame is positionable in circumscribing alignment with the inner frame; and a resilient member spanning the first end portion and second end portion of the outer frame split portion, the resilient member operable to provide a biasing force for abutting the inner frame outer surface against the outer frame inner surface when the outer frame is positioned in circumscribing alignment with the inner frame; and a cover coupled to the outer frame and adjacent the resilient member, the cover including a first cover portion adjacent to the first end portion of the outer frame split portion and a second cover portion adjacent to the second end portion of the outer frame split portion, wherein the first cover portion and second cover portion are in sliding engagement, wherein the first cover portion includes an extension having a terminal end, the extension in sliding engagement with the second cover portion; and wherein the first and second end portions of the outer frame split portion are further moveable to a third position, wherein the distance between the first and second end portions in the third position is greater than the distance between the first and second end portions in the second position; and a pin, the pin extending through the inner and outer surfaces of the outer frame, the pin selectively moveable between an engaging position, wherein the pin is capable of engaging the first cover portion extension terminal end when the first and second end portions of the outer frame split portion are in the third position so as to maintain the first and second end portions of the outer frame split portion in the third position, and a disengaged position, wherein the first end and second end portions of the outer frame split portion are moved by way of the resilient member towards at least one of the first and second end portion first position and second position.

2. The embroidery hoop of claim 1 wherein the resilient member is an extension spring.

3. The embroidery hoop of claim 1 wherein the inner frame is generally annular shaped.

4. The embroidery hoop of claim 1 wherein the outer frame is generally annular shaped.

5. The embroidery hoop of claim 1 wherein the outer frame includes a top surface, the top surface tapered towards the inner surface of the outer frame.

6. The embroidery hoop of claim 1 further comprising a second resilient member operable to bias the pin towards the engaging position.

7. The embroidery hoop of claim 6 wherein the second resilient member is a compression spring.

* * * * *